US007209651B1

(12) United States Patent
Knoeppel et al.

(10) Patent No.: US 7,209,651 B1
(45) Date of Patent: Apr. 24, 2007

(54) FLUID-HEATING APPARATUS, CIRCUIT FOR HEATING A FLUID, AND METHOD OF OPERATING THE SAME

(75) Inventors: Ray O. Knoeppel, Hartland, WI (US); David E. Morris, Racine, WI (US)

(73) Assignee: AOS Holding Company, Wilmington, DE (US)

( * ) Notice: Subject to any disclaimer, the term of this patent is extended or adjusted under 35 U.S.C. 154(b) by 0 days.

(21) Appl. No.: 11/296,053

(22) Filed: Dec. 7, 2005

(51) Int. Cl.
*F24H 1/20* (2006.01)

(52) U.S. Cl. ..... 392/451; 219/497; 219/482

(58) Field of Classification Search ..... None
See application file for complete search history.

(56) References Cited

U.S. PATENT DOCUMENTS

| | | | | |
|---|---|---|---|---|
| 4,103,319 | A | 7/1978 | Crain et al. | |
| 4,520,417 | A | 5/1985 | Frank | |
| 5,039,842 | A | 8/1991 | Kochajda | |
| 5,710,408 | A | 1/1998 | Jones | |
| 5,973,896 | A | 10/1999 | Hirsh et al. | |
| 6,080,973 | A | 6/2000 | Thweatt, Jr. | |
| 6,112,013 | A | 8/2000 | Hsiao et al. | |
| 6,218,647 | B1 | 4/2001 | Jones | |
| 6,646,237 | B2 | 11/2003 | Liu | |
| 6,730,884 | B2 | 5/2004 | Baker et al. | |
| 2001/0020615 | A1* | 9/2001 | Bradenbaugh | 219/497 |
| 2004/0161227 | A1* | 8/2004 | Baxter | 395/454 |
| 2006/0013573 | A1* | 1/2006 | Phillips | 392/459 |

OTHER PUBLICATIONS

Ray O. Knoeppel et al., U.S. Appl. No. 11/296,745, filed Dec. 7, 2005.

* cited by examiner

*Primary Examiner*—Thor S. Campbell
(74) *Attorney, Agent, or Firm*—Michael Best & Friedrich LLP

(57) ABSTRACT

A fluid-heating apparatus for heating a fluid and method of operating the same. The fluid-heating apparatus includes a heating element for heating a fluid surrounding the heating element and a control circuit connected to the heating element and connectable to a power source. The control circuit is configured to determine whether a potential dry-fire condition exists for the heating element. The method includes applying a first electric signal to the heating element, detecting a first value of an electrical characteristic during the application of the first electric signal, applying a second electric signal to the heating element, applying a third electric signal to the heating element, detecting a second value of the electrical characteristic during the application of the third electric signal; and determining whether a potential dry-fire condition exists based on the first and second values.

16 Claims, 8 Drawing Sheets

FLUID-HEATING APPARATUS, CIRCUIT FOR HEATING A FLUID, AND METHOD OF OPERATING THE SAME

BACKGROUND

The invention relates to a fluid-heating apparatus, such as an electric water heater, that can determine an operating condition of the apparatus, and a method of detecting a dry-fire condition and preventing operation of the fluid-heating apparatus when a dry-fire condition exists.

When an electric-resistance heating element fails in an electric water heater, the operation of the heater is diminished until the element is replaced. This can be an inconvenience to the user of the water heater.

SUMMARY

Failure of the electric-resistance element may not be immediate. For example, the element typically has a sheath isolated from an element wire by an insulator, such as packed magnesium oxide. If the sheath is damaged, the insulator can still insulate the wire and prevent a complete failure of the element. However, the insulator does become hydrated over time and the wire eventually shorts, resulting in failure of the element. The invention, in at least one embodiment, detects the degradation of the heating element due to a damaged sheath prior to failure of the heating element. The warning of the degradation to the element prior to failure of the element allows the user to replace the element with little downtime on his appliance.

A heating element generates heat that can be transferred to water surrounding the heating element. Water can dissipate much of the heat energy produced by the heating element. The temperature of the heating element rises rapidly initially when power is applied and then the rate of temperature rise slows until the temperature of the heating element remains relatively constant. Should power be applied to the heating element prior to the water heater being filled with water or should a malfunction occur in which the water in the water heater is not at a level high enough to surround the heating element, a potential condition known as "dry-fire" exists. Because there is no water surrounding the heating element to dissipate the heat, the heating element can heat up to a temperature that causes the heating element to fail. Failure can occur in a matter of only seconds. Therefore, it is desirable to detect a dry-fire condition quickly, before damage to the heating element occurs.

In one embodiment, the invention provides a method of detecting a dry-fire condition of an electric-resistance heating element. The method includes applying a first electric signal to the heating element and detecting a first value of an electrical characteristic during the application of the first electric signal. The first electric signal is then disconnected from the heating element and a second electric signal, substantially different from the first electric signal, is applied to the heating element. The second electric signal is disconnected from the heating element and a third electric signal, substantially different from the second electric signal, is applied to the heating element. A second value of the electrical characteristic is detected during the application of the third electric signal, and a determination is made of the potential for a dry-fire condition based on the first and second values of the electrical characteristic.

In another embodiment, the invention provides a fluid-heating apparatus for heating a fluid. The fluid-heating apparatus includes a vessel, an inlet to introduce the fluid into the vessel, an outlet to remove the fluid from the vessel, a heating element, and a control circuit. The control circuit is configured to apply a first electric signal to the heating element, read a first value of an electrical characteristic, apply a second electric signal to the heating element, the second electric signal being substantially different than the first electric signal, apply a third electric signal to the heating element, the third electric signal being substantially different than the second electric signal, read a second value of the electrical characteristic, determine whether a potential dry-fire condition exists based on the first and second values, and apply a fourth electric signal to the heating element if the potential dry-fire condition does not exist, the fourth electric signal being substantially different than the first third signal.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising " or "having" and variations thereof herein is meant to encompass the items listed thereafter and equivalents thereof as well as additional items. The terms "mounted," "connected,"

"supported," and "coupled" are used broadly and encompass both direct and indirect mountings, connections, supports, and couplings. Further, "connected" and "coupled" are not restricted to physical or mechanical connections or couplings, and can include electrical connections or couplings, whether direct or indirect.

Figure 1:
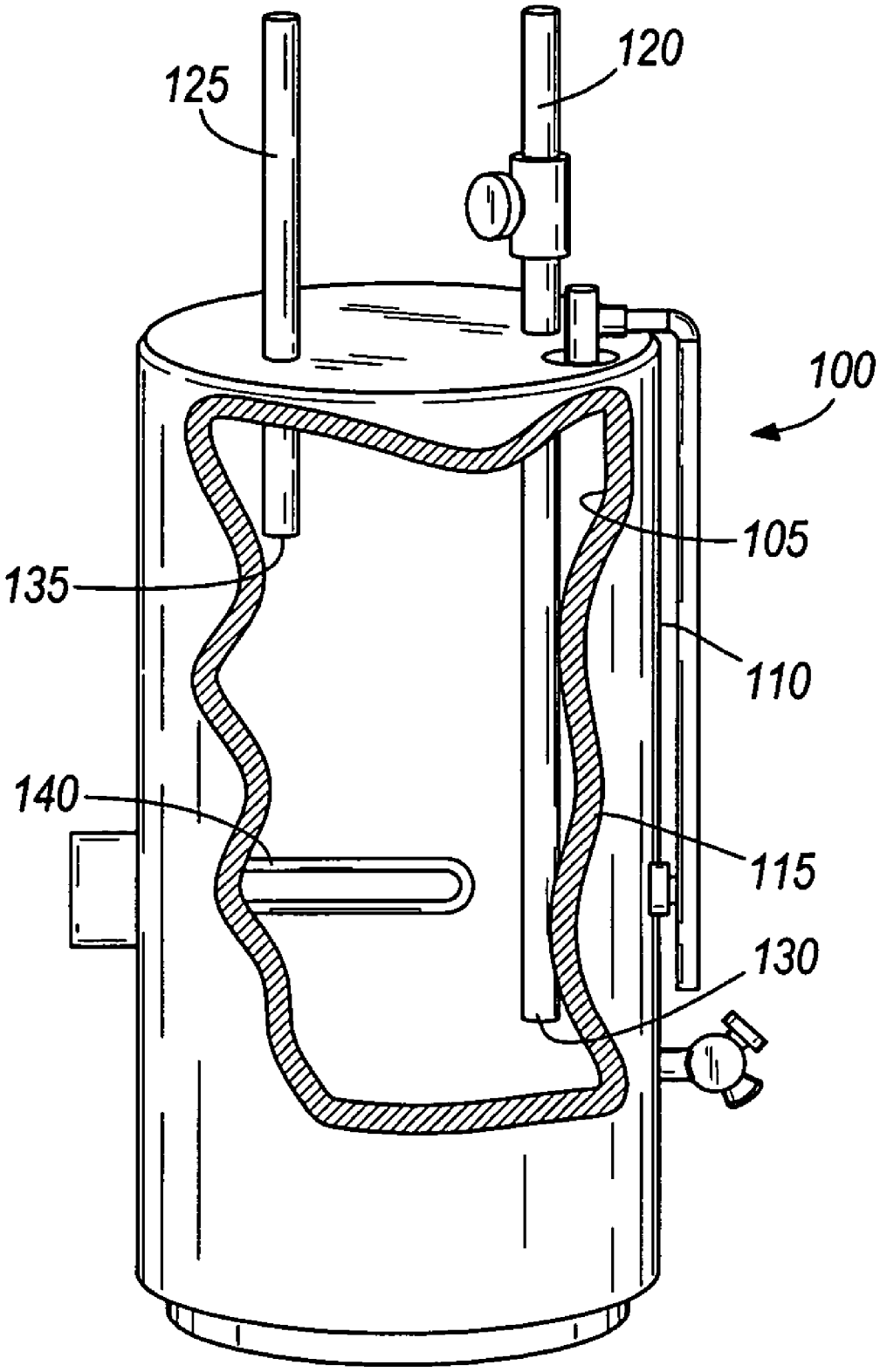
FIG. 1 is a partial exposed view of a water heater embodying the invention.

FIG. 1 illustrates a storage-type water heater 100 including an enclosed water tank 105 (also referred to herein as an enclosed vessel), a shell 110 surrounding the water tank 105, and foam insulation 115 filling the annular space between the water tank 105 and the shell 110. A typical storage tank 105 is made of ferrous metal and lined internally with a glass-like porcelain enamel to protect the metal from corrosion. However, the storage tank 105 can be made of other materials, such as plastic. A water inlet line or dip tube 120 and a water outlet line 125 enter the top of the water tank 105. The water inlet line 120 has an inlet opening 130 for adding cold water to the water tank 105, and the water outlet line 125 has an outlet opening 135 for withdrawing hot water from the water tank 105. The tank may also include a grounding element (or contact) that is in contact with the water stored in the tank. Alternatively, the grounding element can be part of another component of the water heater, such as the plug of the heating element (discussed below). The grounding element comprises a metal material that allows a current path to ground.

Figure 2:
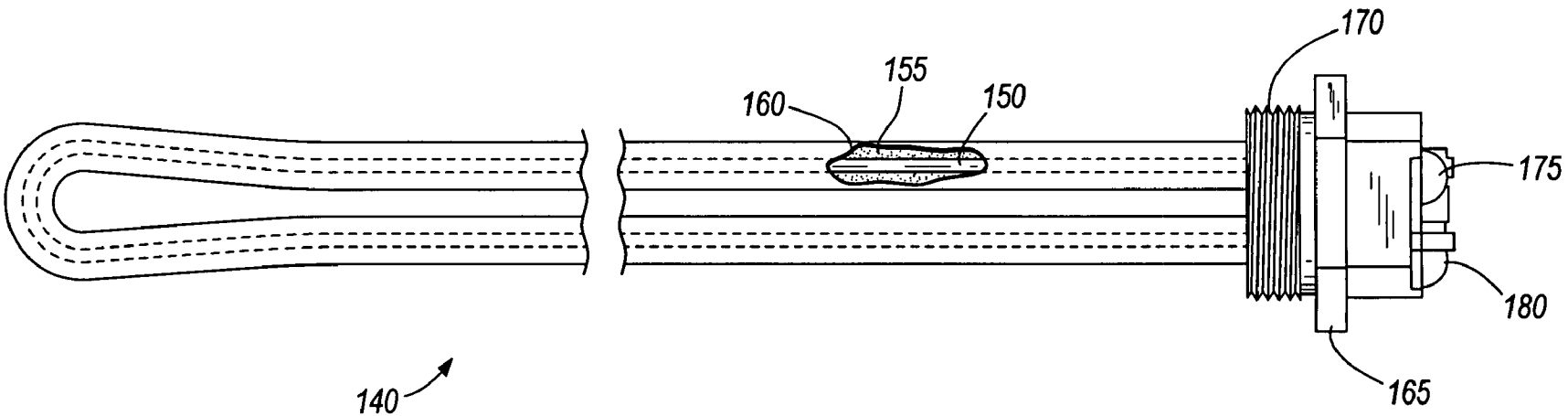
FIG. 2 is a partial exposed, partial side view of an electrode capable of being used in the water heater of FIG. 1.

The water heater 100 also includes an electric resistance heating element 140 that is attached to the tank 105 and extends into the tank 105 to heat the water. An exemplary heating element 140 capable of being used in the water heater 100 is shown in FIG. 2. With reference to FIG. 2, the heating element 140 includes an internal high resistance heating element wire 150, surrounded by a suitable insulating material 155 (such as packed magnesium oxide), a metal jacket (or sheath) 160 enclosing the insulating material, and an element connector assembly 165 (typically referred to as a plug) that couples the metal jacket 160 to the shell 110, which may be grounded. For the construction shown, the connector assembly 165 includes a metal spud 170 having threads, which secure the heating element 140 to the shell 110 by mating with the threads of an opening of the shell 110. The connector assembly 165 also includes connectors 175 and 180 for electrically connecting the wire 150 to the control circuit (discussed below), which provides controlled power to the wire 150. While a water heater 100 having the element 140 is shown, the invention can be used with other fluid-heating apparatus for heating a conductive fluid, such as an instantaneous water heater or an oil heater, and with other heater element designs and arrangements.

Figure 3:
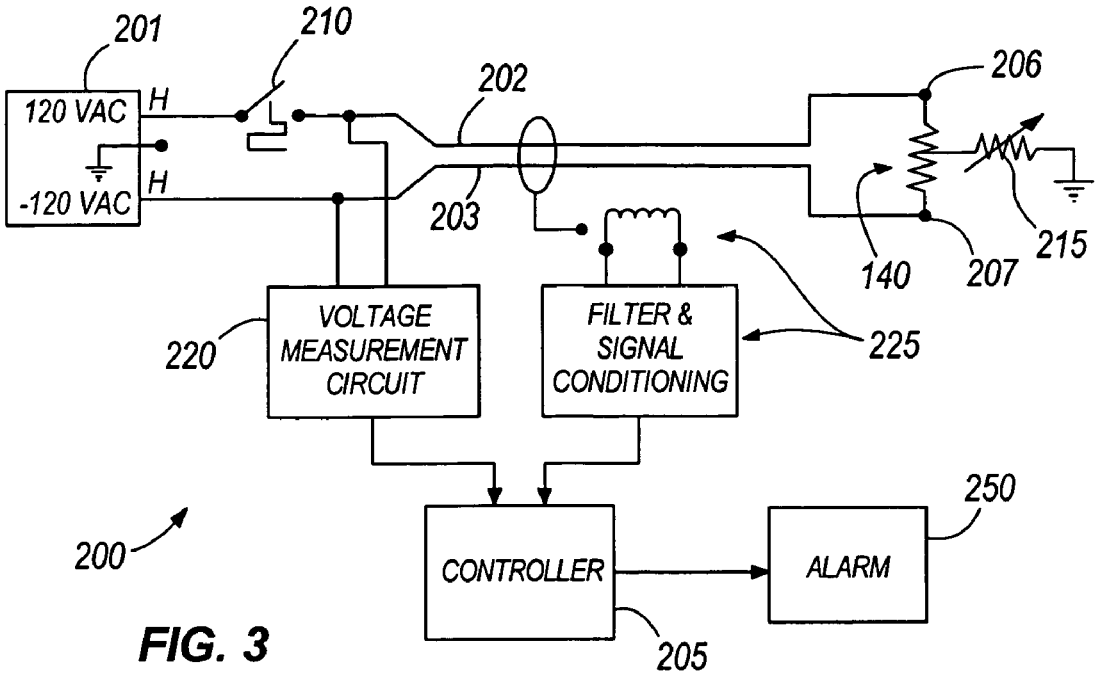
FIG. 3 is a partial block diagram, partial electric schematic of a first control circuit capable of controlling the electrode of FIG. 2.

A partial electrical schematic, partial block diagram for one construction of a control circuit 200 used for controlling the heating element 140 is shown in FIG. 3. The control circuit 200 includes a microcontroller 205. As will be discussed in more detail below, the microcontroller 205 receives signals or inputs from a plurality of sensors or circuits, analyzes the inputs, and generates one or more outputs to control the water heater 100. In one construction, the microcontroller 205 includes a processor and memory. The memory includes one or more modules having instructions. The processor obtains, interprets, and executes the instructions to control the water heater 100. Although the microcontroller 205 is described as having a processor and memory, the invention may be implemented with other controllers or devices including a variety of integrated circuits (e.g., an application-specific-integrated circuit) and discrete devices, as would be apparent to one of ordinary skill in the art. Additionally, the microcontroller 205 and the control circuit 200 can include other circuitry and perform other functions not discussed herein as is known in the art.

Referring again to FIG. 3, the control circuit 200 further includes a current path from a power supply 201 to the heating element 140 back to the power supply 201. The current path includes a first leg 202 and a second leg 203. The first leg 202 connects the power source 201 to a first point 206 of the heating element 140 and the second leg 203 connects the power source 201 to a second point 207 of the heating element 140. A thermostat, which is shown as a switch 210 that opens and closes depending on whether the water needs to be heated, is connected in the first leg 202 between the power source 201 and the heating element 206. When closed, the thermostat switch 210 allows a current from the power source 201 to the heating element 140 and back to the power source 201 via the first and second legs 202 and 203. This results in the heating element 140 heating the water to a desired set point determined by the thermostat. The heating of the water to a desired set point is referred to herein as the water heater 100 being in a heating state. When open, the thermostat switch 210 prevents a current flow from the power source 201 to the heating element 140 and back to the power source 201 via the first and second legs 202 and 203. This results in the water heater 100 being in a non-heating state. Other methods of sensing the water temperature and controlling current to the heating element 140 from the power source 201 are possible (e.g., an electronic control having a sensor, the microcontroller 205 coupled to the sensor to receive a signal having a relation to the sensed temperature, and an electronic switch such as a triac controlled by the microcontroller in response to the sensed temperature).

As just stated, the thermostat switch 210 allows a current through the heating element 140 when the switch 210 is closed. A variable leakage current can flow from the element wire 150 to the sheath 160 via the insulating material 155 when a voltage is applied to the heating element 140. The variable resistor 215 represents the leakage resistance, which allows the leakage path. The resistance between the wire and ground drops from approximately 4,000,000 ohms to approximately 40,000 ohms or less when the heating element 140 degrades due to a failure in the sheath 160. This will be discussed in more detail below.

The control circuit 210 further includes a voltage measurement circuit 220 and a current measurement circuit 225. The voltage measurement circuit 220, which can include a filter and a signal conditioner for filtering and conditioning the sensed voltage to a level suitable for the microcontroller 205, senses a voltage difference between the first and second legs 202 and 203. This voltage difference can be used to determine whether the thermostat switch 210 is open or closed. The current measurement circuit 225 senses a current to the heating element 140 with a torroidal current transformer 230. The torroidal current transformer 235 can be disposed around both legs 202 and 203 to prevent current sense signal overload during the heating state of the water heater 100, and accurately measure leakage current during the non-heating state of the water heater 100. The current measurement circuit 225 can further include a filter and signal conditioner for filtering and conditioning the sensed current value to a level suitable for the microcontroller 205.

During operation of the water heater 100, the sheath 160 may degrade resulting in a breach (referred to herein as the aperture) in the sheath 160. When the aperture exposes the insulating material 155, the material 155 may absorb water.

Eventually, the insulating material 155 may saturate, resulting in the wire 150 becoming grounded. This will result in the failure of the element 140.

When the insulating material 155 absorbs water, the material 155 physically changes as it hydrates. The hydrating of the insulating material 155 decreases the resistance 215 of a leakage path from the element wire 150 to the grounded element (e.g., the heating element plug 165 and the coupled sheath 160). The control circuit 200 of the invention recognizes the changing of the resistance 215 of the leakage path, and issues an alarm when the leakage current increases to a predetermined level.

More specific to FIG. 3, it is common in the United States to apply 240 VAC to the element wire 140 by connecting a first 120 VAC to the first leg 202 and a second 120 VAC to the second leg 203. The thermostat switch 210 removes the first 120 VAC from being applied to the heating element 140, thereby having the water heater 100 enter a non-heating state. However, as shown in FIG. 3, the second 120 VAC through the second leg is still applied to the heating element 140. As a consequence, a leakage current can still flow through the leakage resistance 215. The voltage measurement circuit 220 provides a signal to the microcontroller 205 representing, either directly or through analysis by the microcontroller 205, whether the thermostat switch 210 is in an open state, and the current measurement circuit 230 provides a signal to the microcontroller 205 representing, either directly or through analysis by the microcontroller 205, the current through the circuit path including the leakage current. The microcontroller 205 can issue an alarm when the measured leakage current is greater than a threshold indicating the heating element 140 has a degrading sheath 160. The threshold value can be set based on empirical testing for the model of the water heater 100. The alarm can be in the form of a visual and/or audio alarm 250. It is even envisioned that the alarm can be in the form of preventing further heating of the water until the heating element 140 is changed.

In another construction of the water heater 100, the voltage measurement circuit 220 may not be required if the control of the current to the heating element 140 is performed by the microcontroller 205. That is, the voltage measurement circuit 220 can inform the microcontroller 205 when the water heater 100 enters a heating state. However, in some water heaters, the microcontroller 205 receives a temperature of the water in the tank 105 from a temperature sensor and controls the current to the heating element 140 via a relay (i.e., directly controls the state of the water heater 100). For this construction, the voltage measurement circuit 220 is not required since the microcontroller knows the state of the water heater 100.

In yet another construction of the water heater 100, the microcontroller 205 (or some other component) may control the current measurement circuit 225 to sense the current through the heating element 140 only during the "off" state. This construction allows the current measurement circuit 225 to be more sensitive to the leakage current during the non-heating state.

Referring to TABLE 1, the table provides the results of eight tests performed on eight different elements. Each of the elements where similar in shape to the element 140 shown in FIG. 2. The elements were 4500 watt elements secured in 52 gallon electric water heaters similar in design to the water heater 100 shown in FIG. 1. Various measurements of the elements were taken during the tests. The measurements include the "Power 'On' Average Measured Differential Current", the "Power 'On' Maximum Measured Differential Current", the "Power 'Off' Average Measure Differential Current (ma)", and the "Power 'Off' Maximum Measured Differential current." Aperture were introduced to the sheath 160 of elements E, F, G, and H. The apertures resulted in the degradation of the insulating materials 155. Measurements for the elements EFGH were taken while the insulators degraded. The data in TABLE 1 shows that the current measurements of elements with intact sheaths 160 taken during the "on" state (or heating state), overlap with the current measurements of elements with a damaged sheath 160. For example, the element "Edge Hole G", has a lower average current than the good element C and the good element D. In contrast, the current measurements made during the "off" state (or non-heating state) indicate a wide gap in current readings for an element with a damaged sheath 160 versus the element with an intact sheath 160. For example, the lowest average current measured for a degraded sheath 160, Edge Hole G at 12.5 ma, is over six times higher than the highest average current measured for an uncompromised element, i.e., Good D.

TABLE 1

| | DIFFERENTIAL CURRENT MEASUREMENTS | | | |
|---|---|---|---|---|
| ELEMENT | POWER "ON" AVERAGE MEASURED DIFFERNITAL CURRENT(ma) | POWER "ON" MAXIMUM MEASURED DIFFERENITAL CURRENT (ma) | POWER "OFF" AVERAGE MEASURED DIFFERNTIAL CURRENT(ma) | POWER "OFF" MAXIMUM MEASURED DIFFERENTIAL CURRENT(ma) |
| GoodA | 0.45 | 2.78 | 0.56 | 3.15 |
| GoodB | 3.78 | 4.19 | 0.15 | 1.72 |
| GoodC | 4.41 | 5.15 | 0.10 | 0.12 |
| GoodD | 8.38 | 9.73 | 2.07 | 2.90 |
| Center HoleE | 59.9 | >407 | 218.8 | >407 |
| Center HoleF | 79.8 | >407 | 144.3 | 378 |
| Edge HoleG | 4.38 | 24.5 | 12.5 | 78.2 |
| Edge HoleH | 9.44 | 14.7 | 13.8 | 15.2 |

Figure 4:
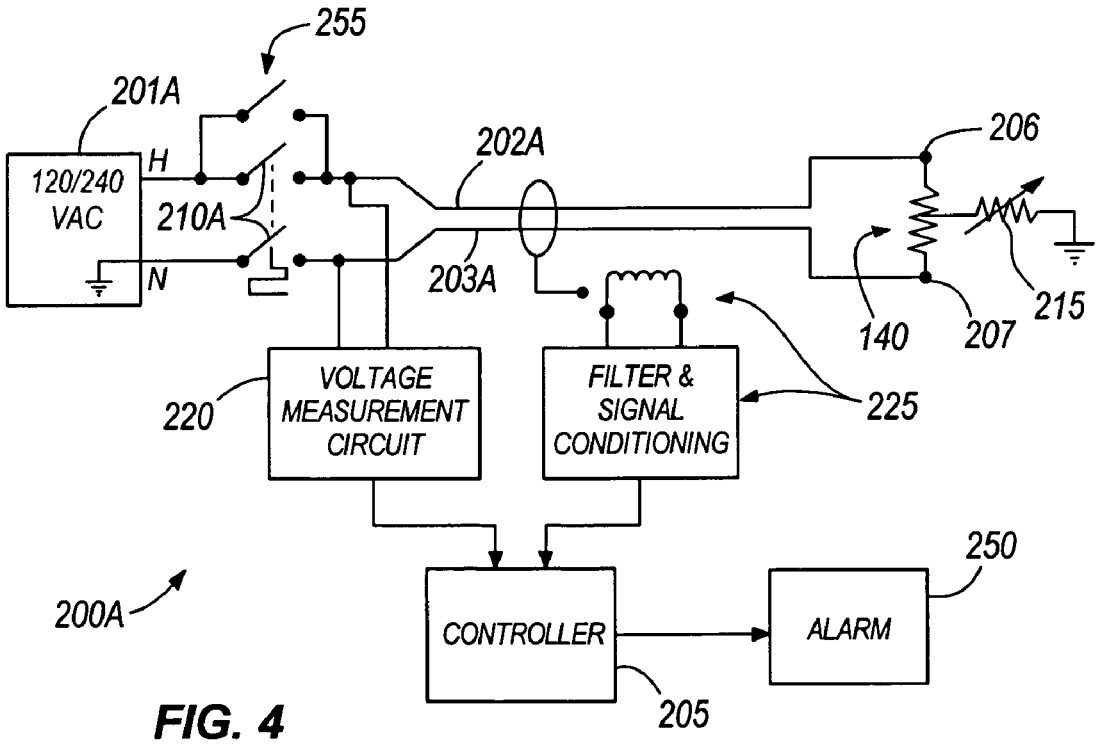
FIG. 4 is a partial block diagram, partial electric schematic of a second control circuit capable of controlling the electrode of FIG. 2.

A partial electrical schematic, partial block diagram for another construction of the control circuit 200A used for controlling the heating element 140 is shown in FIG. 4.

Similar to the construction shown in FIG. 3, the control circuit 200A includes the microcontroller 205, the thermostat switch 210A, the voltage measurement circuit 220, and the current measurement circuit 225. However, for the construction of the control circuit in FIG. 4, the first leg 202A of the circuit 200A is connected to 120 VAC or 240 VAC and the second leg 203A of the control circuit 200 is connected to ground. As further shown in FIG. 4, the double pole thermostat switch 210A is electrically connected between the current measurement circuit 225 and 120 VAC or 240 VAC. The operation of the control circuit 200A for FIG. 4 is similar to the control circuit 200 for FIG. 3. TABLE 2 demonstrates a comparison between a heating element 140 initially having no apertures and the element 140 having an aperture at the edge of the element 140. As can be seen, TABLE 2 demonstrates a large difference in current between the degraded element and the good element during the non-heating state.

TABLE 2

DIFFERENTIAL CURRENT MEASUREMENTS DURING POWER "OFF" CONDITION (240 VAC)

| ELEMENT ID | Starting Current (mA) | Current at 1 Hour (mA) |
|---|---|---|
| Good | 0.04 mA | 0.15 mA |
| Center Hole | 560 mA | 693 mA |

Before proceeding further, it should be understood that the constructions described thus far can include additional circuitry to allow for intermittent testing. For example and as shown in FIG. 2, a second switch 255 controlled by the microcontroller 225 can be added to attach the power source 201A to the heating element 140 when thermostat switch 210A is open, allowing the microcontroller 225 to perform a leakage current calculation.

Figure 5:
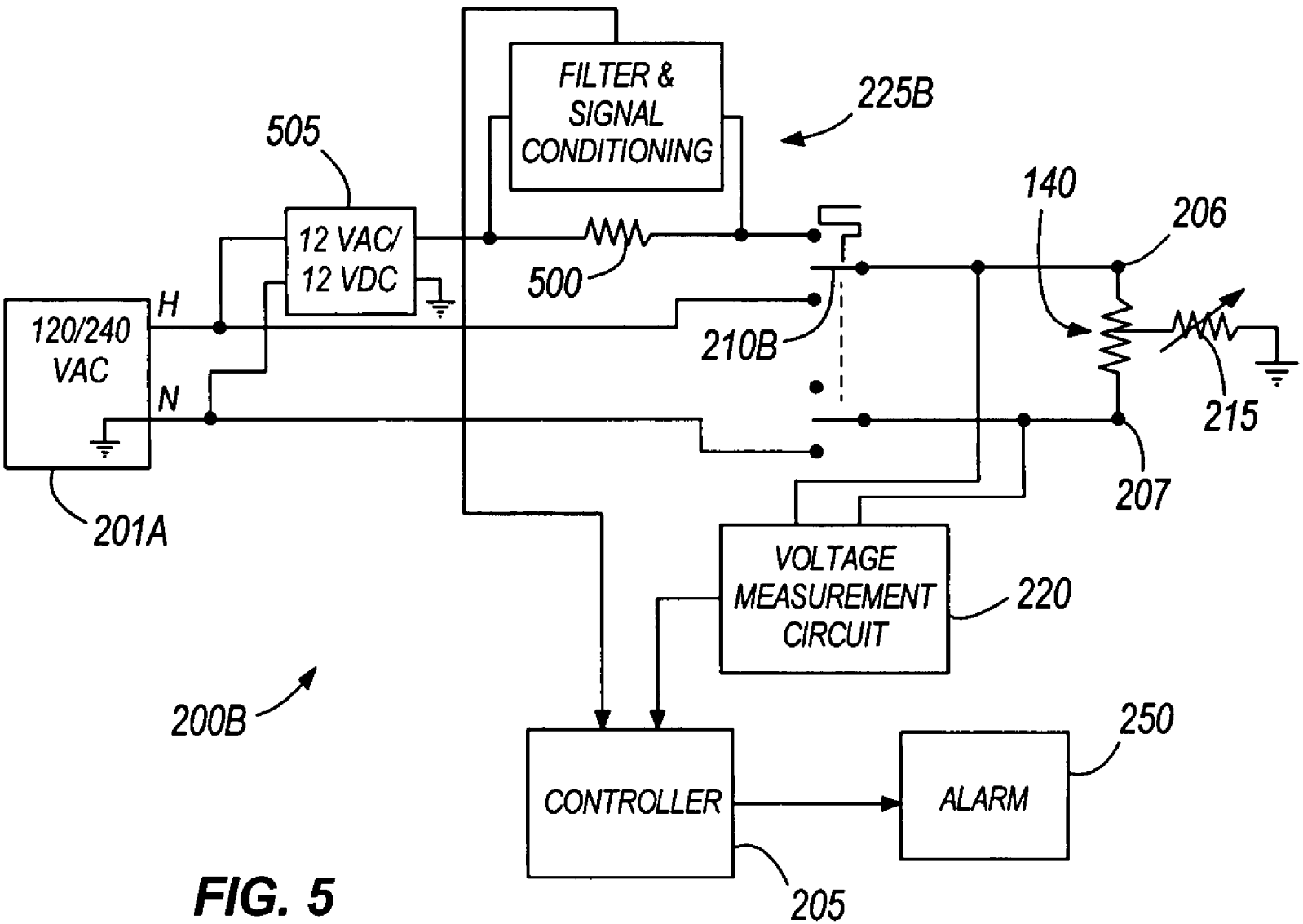
FIG. 5 is a partial block diagram, partial electric schematic of a third control circuit capable of controlling the electrode of FIG. 2.

A partial electrical schematic, partial block diagram for yet another construction of the control circuit 200B used for controlling the heating element 140 is shown in FIG. 5. Similar to the construction shown in FIG. 3, the control circuit 200B includes the microcontroller 205, a thermostat switch 210B, the voltage measurement circuit 220, and a current measurement circuit 225B. However, for the construction of the control circuit 200B in FIG. 5, the arrangement and operation of the circuit 200B shown in FIG. 5 is slightly different than the arrangement of the circuit 200 shown in FIG. 3. As shown in FIG. 5, the current measurement circuit 225B includes a current resistive shunt 500 that is electrically connected between a 12 VDC (or 12 VAC) power supply 505 and the thermostat switch 210B. The thermostat switch 210B is controlled by the thermostat temperature sensor and switches between the 120 VAC (or 240 VAC) power source and the 12 VDC (or 12VAC) power supply 505. The voltage measurement circuit 220 is electrically connected in parallel with the heating element to determine the state of the water heater 100. The operation of the control circuit 200B for FIG. 5 is somewhat similar to the control circuit 200 for FIG. 3. However, unlike the control circuit 200 for FIG. 3, when the control circuit 200B moves to the non-heating state, the thermostat switch 210B applies the voltage of the low-voltage power supply 505 to the heating element 140. TABLE 3 demonstrates a comparison between a heating element 140 initially having no apertures and the element 140 having an aperture at the edge of the element 140. As can be seen, TABLE 3 demonstrates a large difference in current between the degraded element and the good element during the non-heating state.

TABLE 3

DIFFERENTIAL CURRENT MEASUREMENTS DURING POWER "OFF" CONDITION (12 VDC)

| ELEMENT ID | Starting Current (mA) | Current at 1 Hour (mA) |
|---|---|---|
| Good | 0.0 mA | 0.0 mA |
| Center Hole | 18 mA | 18 mA |

Figure 6A:
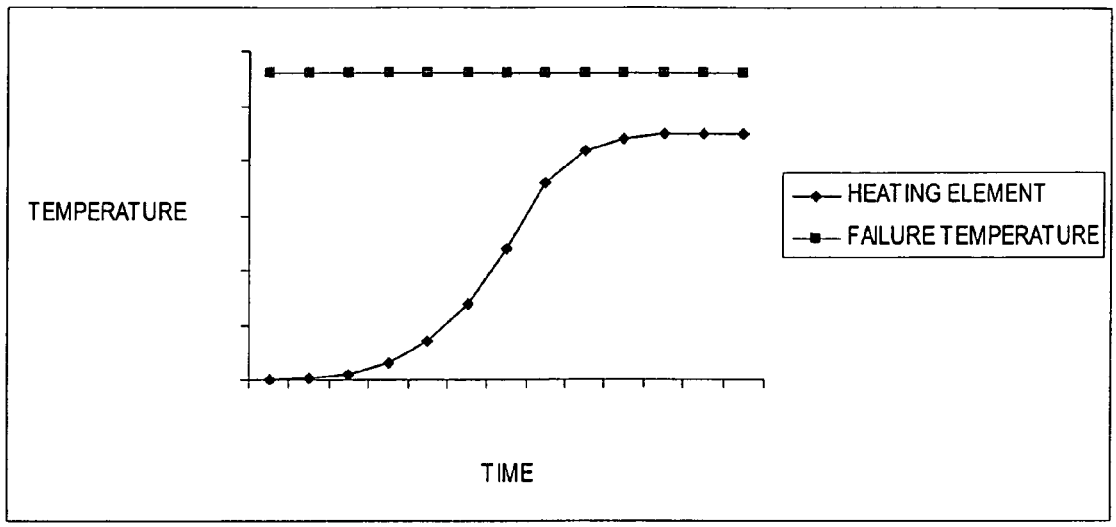
FIG. 6A is a chart of a temperature curve of the electrode of FIG. 2 submerged in water.

When the temperature in the water heater 100 drops below a predetermined threshold the water heater 100 attempts to heat the water to a temperature greater than the predetermined threshold plus a dead band temperature by applying power to the heating element 140. The heating element 140 generates heat that can be transferred to water surrounding the heating element 140. Much of the heat energy produced by the heating element 140 can be dissipated by the water. FIG. 6A illustrates the temperature of a heating element 140 following application of power to the heating element 140 and wherein the heating element 140 is surrounded by water. The temperature of the heating element 140 rises rapidly initially and then the temperature rise slows until the temperature of the heating element 140 remains relatively constant. The constant temperature maintained by the heating unit 140 can be below a temperature wherein the heating element 140 fails.

Figure 6B:
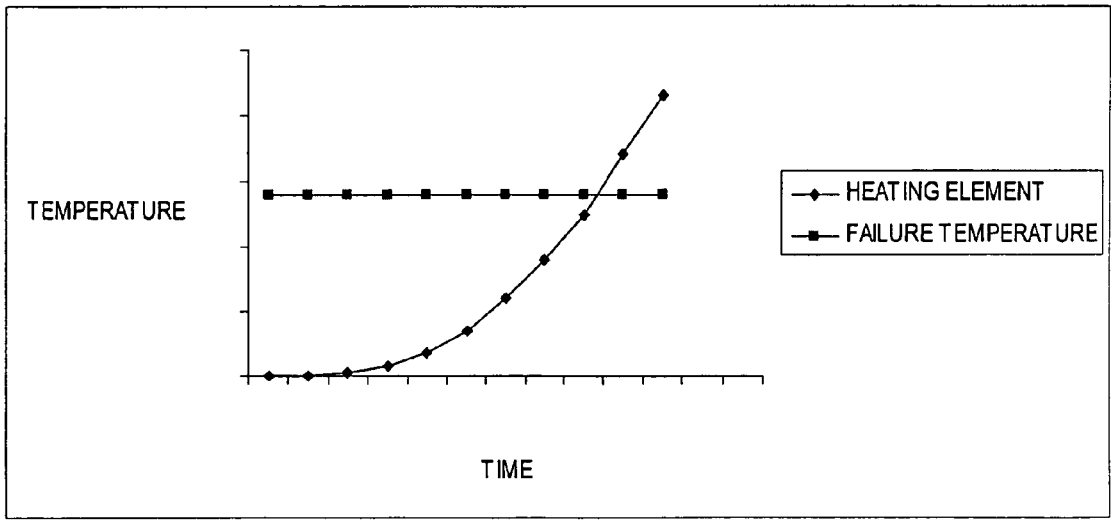
FIG. 6B is a chart of a temperature curve of the electrode of FIG. 2 exposed to air.

Should power be applied to the water heater 100 prior to the water heater 100 being filled with water or should a malfunction occur in which the water in the water heater 100 is not at a level high enough to surround the heating element 140, applying power to the heating element 140 creates a condition known as "dry-fire." As shown in FIG. 6B, during a dry-fire condition the heating element 140 heats up and, because there is no water surrounding the heating element 140 to dissipate the heat, continues to heat up to a temperature that causes the heating element 140 to fail. Failure of the heating element 140 during a dry-fire condition can occur in only a matter of seconds. It is, therefore, desirable to detect a dry-fire condition quickly, before damage occurs to the heating element 140.

Figure 7:
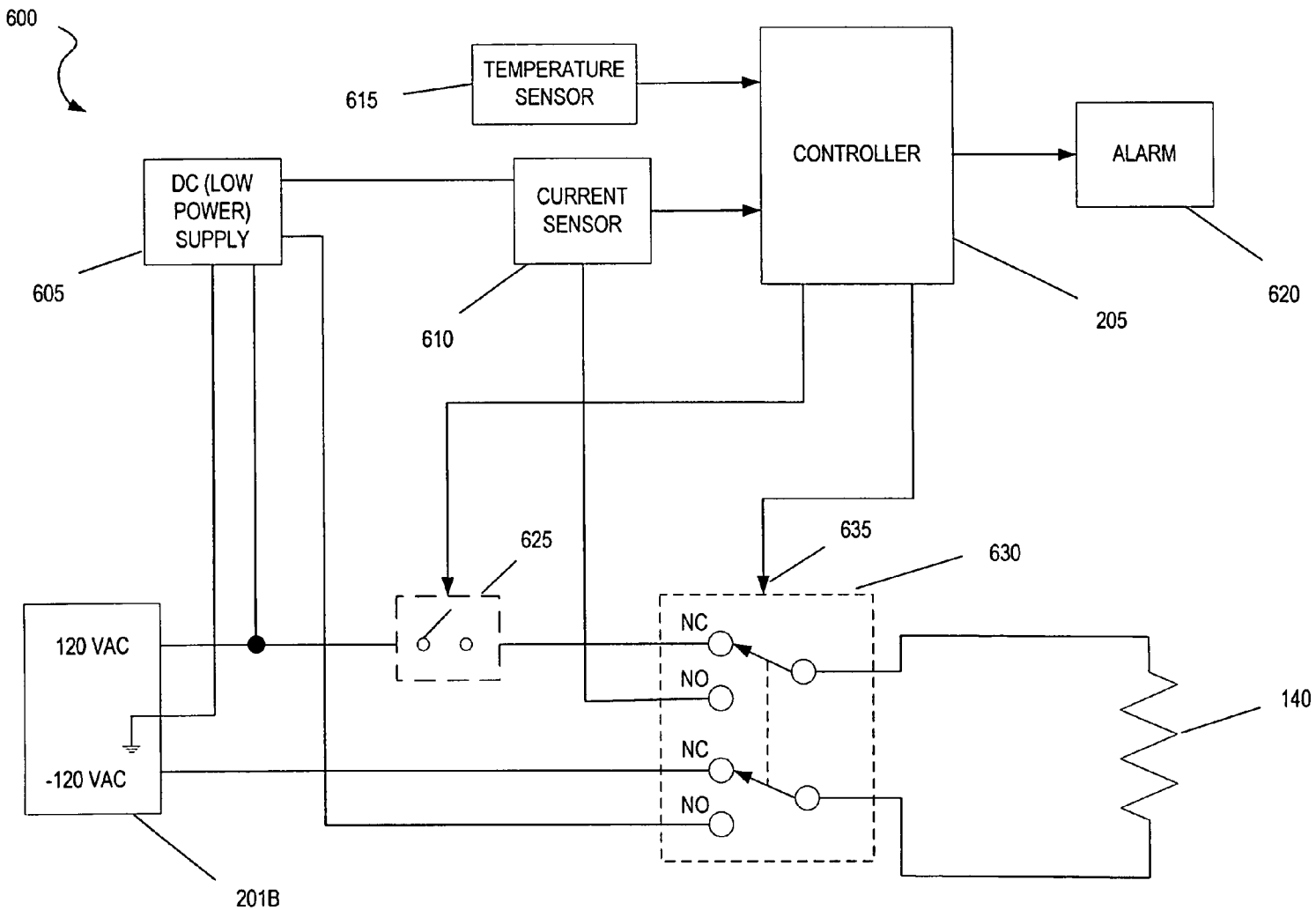
FIG. 7 is partial block diagram, partial electric schematic of a fourth control circuit capable of controlling the electrode of FIG. 2 and detecting a dry-fire condition.

FIG. 7 illustrates a partial block diagram, partial schematic diagram of a construction of a fourth control circuit 600 that detects a dry-fire condition and prevents power from being applied to the heating element 140 when a dry-fire condition exists.

In some constructions, the control circuit 600 includes a relatively high-voltage power source (e.g., 120 VAC, 240 VAC, etc.) 201B, a heating element 140, a relatively low voltage power source (e.g., +12 VDC, 12 VAC, +24 VDC, etc.) 605, a current sensing circuit 610, a controller 205, a temperature sensing circuit 615, an alarm 620, a normally open switch 625, and a double-pole, double-throw relay 630

As shown in the construction of FIG. 7, the normally closed ("NC") contacts of the relay 630 are coupled to the high-voltage power source 201B through switch 625. The normally open ("NO") contracts of the relay 630 are coupled to the low-voltage power supply 605. The output contacts of the relay 630 are coupled to the heating element 140. When the switch 625 is closed and power is not applied to the coil (indicated at 635) of the relay 630, the relay 630 remains in a state wherein the normally closed contacts remain closed and high voltage is applied to the heating element 140 enabling the heating element 140 to generate heat. When power is applied to the coil 635 of the relay 630, the relay 630 closes the NO contacts and +12VDC is applied to the heating element 140. The voltage of the low-voltage power supply 605 can be selected such that the heating element 140 would not be harmed from prolonged exposure in a dry-fire condition.

In this construction, the controller 205 is coupled to the temperature sensor 615 and the current sensor 610, and receives indications of the temperature in the water heater 100 and the current drawn from the low-voltage power supply 605 from each sensor respectively. The controller 205 is also coupled to the alarm 620, the switch 625, and the relay 630.

Figure 8:
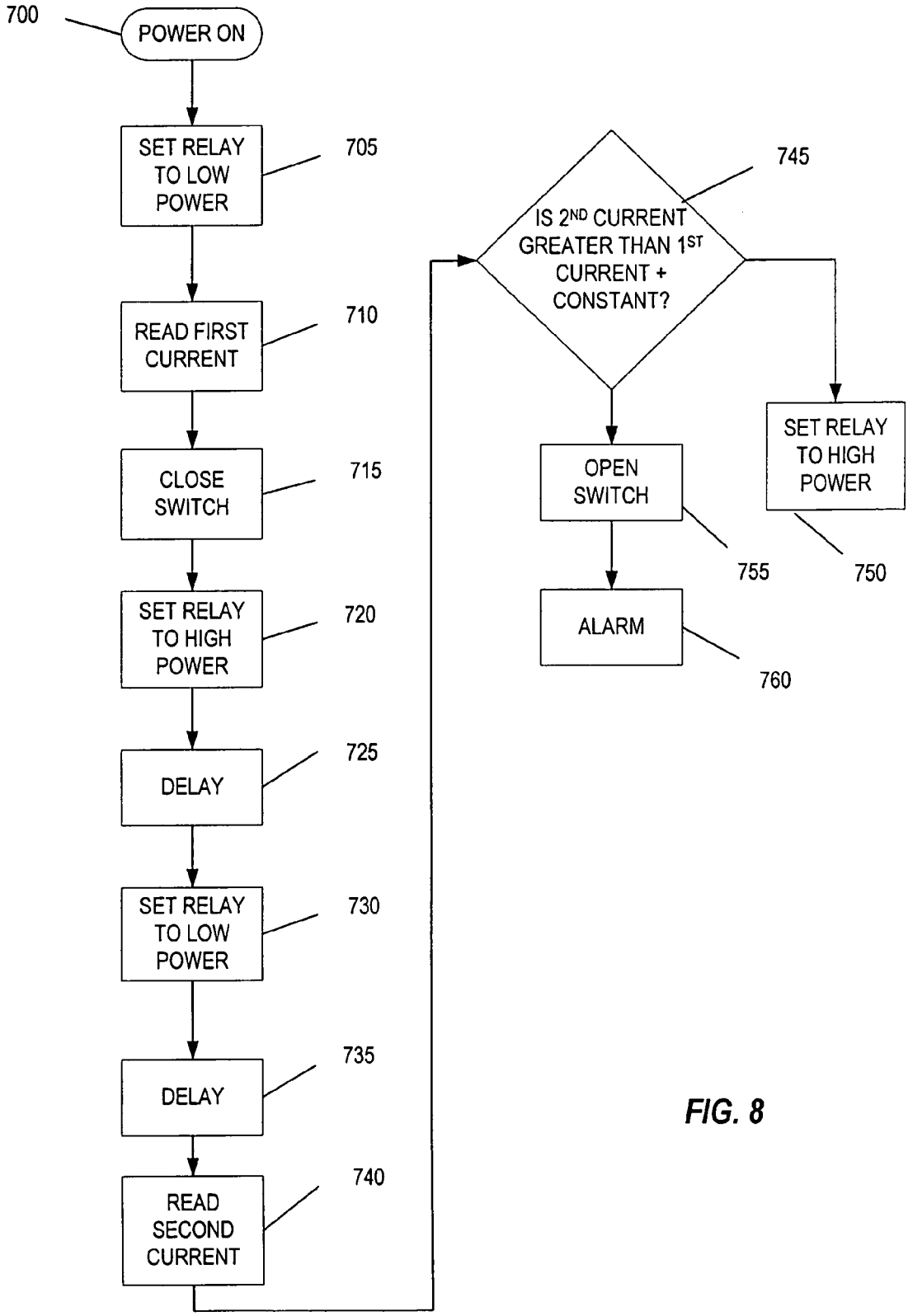
FIG. 8 is a flowchart of the operation of the control circuit of FIG. 7 for detecting a dry-fire condition.

FIG. 8 represents a flow chart of an embodiment of the operation of the control circuit 600 for detecting a dry-fire condition. When the water heater 100 is powered on (block 700), the controller 205 applies power (block 705) to the coil 635 of the relay 630. This opens the NC contacts of the relay 630 and closes the NO contacts of the relay 630. Closing the NO contacts of the relay 630 couples the low-voltage power supply 605 to the heating element 140.

In some constructions, the controller reads (block 710), from the current sensor 610, a first current being supplied by the low-voltage power supply 605 to the heating element 140. Other constructions of the dry-fire detection system 600 can read other electrical characteristics (e.g., voltage via a voltage sensor) of the circuit created by the low-voltage power supply 605 and the heating element 140.

Next, the controller 205 closes (block 715) the switch 625 and couples the high-voltage power supply 201B to the NC contacts of the relay 630. The controller 205 also removes (block 720) power from the coil 635 of the relay 630. This opens the NO contracts of the relay 630 which decouples the low-voltage power supply 605 from the heating element 140 and closes the NC contacts of the relay 630 coupling the high-voltage power supply 201B to the heating element 140. Coupling the high-voltage power supply 201B to the heating element 140 causes the heating element 140 to heat up. The controller 205 delays (block 725) for a first time period (e.g., three seconds).

Following the delay (block 725), the controller 205 applies (block 730) power to the coil 635 of the relay which opens the NC contacts of the relay 635 and decouples the high-voltage power supply 201B from the heating element 140. The first time period can be a length of time that allows the heating element 140 to heat up but can be short enough to ensure the heating element 140 does not achieve a temperature at which it can fail if a dry-fire condition were to exist. Applying power to the coil 635 of the relay 630 also enables the NO contacts of the relay 630 to close and couples the low-voltage power supply 605 to the heating element 140.

The controller 205 delays (block 735) for a second time period (e.g. ten seconds). During the delay, the heating element 140 begins to cool. The rate at which the heating element 140 cools can be faster if the heating element 140 is surrounded by water. The controller 205 reads (block 740), from the current sensor 610, a second current being supplied by the low-voltage power supply 605 to the heating element 140. The controller 205 compares (block 745) the first sensed current to the second sensed current and determines if the second sensed current is greater than the first sensed current by more than a threshold. If the second sensed current is not greater than the first sensed current by more than the threshold, the controller 205 determines that a dry-fire condition does not exist and continues (block 750) normal operation.

If the second sensed current is greater than the first sensed current by more than the threshold, the controller 205 determines that a dry-fire condition exists and opens (block 755) the switch 625. Opening the switch 625 ensures that the high-voltage power supply 201B is decoupled from the heating element 140 and prevents the heating element from being damaged. The controller 205 then signals (block 760) an alarm to inform an operator of the dry-fire condition.

Figure 9A:
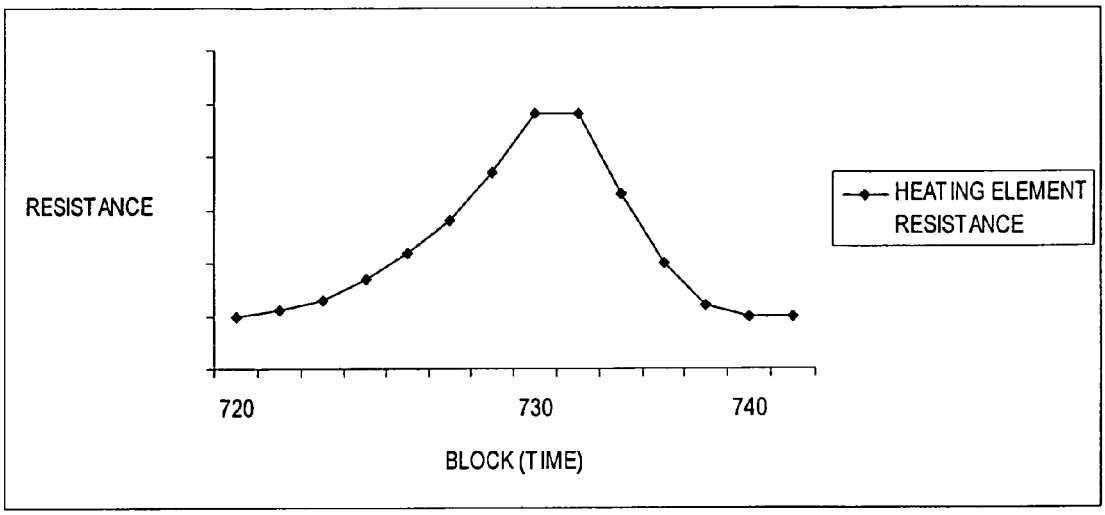
FIG. 9A is a chart of a resistance curve of the electrode of FIG. 2 submerged in water.
Figure 9B:
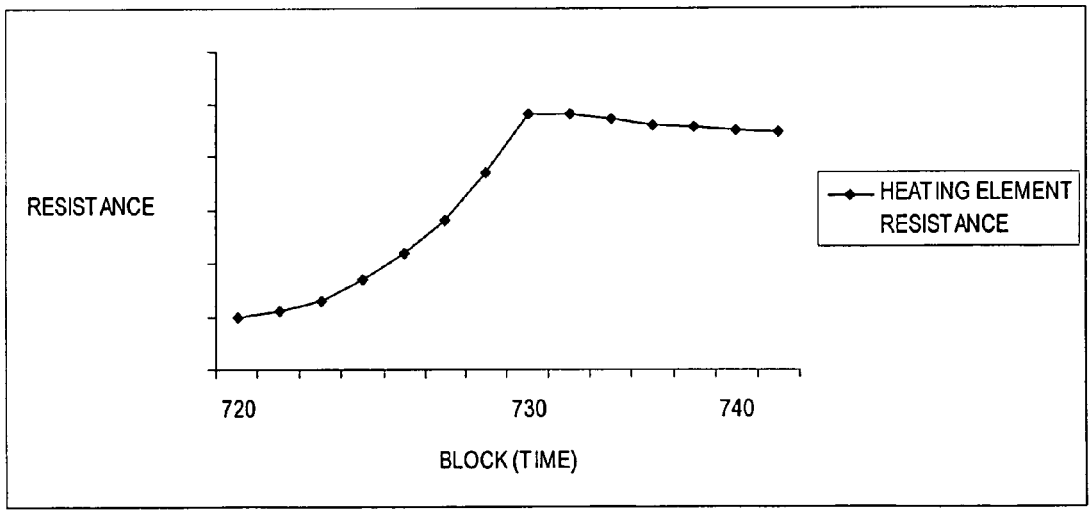
FIG. 9B is a chart of a resistance curve of the electrode of FIG. 2 exposed to air.

FIGS. 9A and 9B illustrate the resistance of the heating element 140 at different points during the dry-fire detection process for a wet-fire condition (FIG. 9A) and a dry-fire condition (FIG. 9B). At block 720, the high-voltage power is applied to the heating element 140. The temperature of the heating element 140 rises which increases the resistance of the heating element 140. After a delay (block 725) the high-voltage power is disconnected from the heating element 140 (block 730). In a wet-fire condition, FIG. 9A, the heating element 140 cools relatively rapidly causing the resistance of the heating element 140 to drop relatively rapidly to near the level of resistance of the heating element 140 prior to originally applying the high voltage as shown at block 740.

Referring to FIG. 9B, the resistance of the heating element 140 in a dry-fire condition is similar to the resistance of the heating element 140 in a wet-fire condition (FIG. 9A) for blocks 720 to 730. Following disconnection of the high-voltage power at block 730 the heating element 140, in a dry-fire condition, retains more heat and has a higher resistance for a relatively longer period of time. Testing an electrical characteristic of a circuit including the heating element 140 as explained at block 740 results in, when a dry-fire condition exists, a relatively large differential between the first reading at block 710 and the second reading at block 740.

The control circuit 600 can execute the dry-fire detection process once, when power is first applied to the water heater 100, each time the temperature sensing circuit 615 indicates that heat is needed, or at some other interval. Other constructions of the control circuit 600 can execute the dry-fire detection process at other times where it is determined that the potential for a dry-fire condition exists (e.g., following a period of time wherein the heating element 140 has been coupled to the high power signal).

Thus, the invention provides, among other things, a new and useful water heater and method of controlling a water heater. Various features and advantages of the invention are set forth in the following claims.

What is claimed is:

1. A method of detecting a dry-fire condition of an electric-resistance heating element, the method comprising:

applying a first electric signal to the heating element;

detecting a first value of an electrical characteristic during the application of the first electric signal;

applying a second electric signal to the heating element, the second electric signal being substantially different than the first electric signal;

applying a third electric signal to the heating element, the third electric signal being substantially different than the second electric signal;

detecting a second value of the electrical characteristic during the application of the third electric signal;

determining whether a potential dry-fire condition exists based on the first and second values.

2. The method of claim 1 wherein the third electric signal is substantially the same as the first electric signal.

3. The method of claim 2 wherein the second electric signal is a high-voltage, alternating current signal.

4. The method of claim 3 wherein the first electric signal is a low-voltage, direct current signal.

5. The method of claim 1 wherein the electrical characteristic is resistance.

6. The method of claim 1 wherein the electrical characteristic is voltage.

7. The method of claim 1 wherein the electrical characteristic is current.

8. The method of claim 1 wherein determining whether a potential dry-fire condition exists comprises comparing the first value of the electrical characteristic to the second value of the electrical characteristic and determining a potential dry-fire condition exists when the second value of the electrical characteristic varies by more than an amount from the first value of the electrical characteristic.

9. The method of claim 1 wherein the method further comprises ceasing application of the first electric signal to the heating element prior to applying the second electric signal, and ceasing application of the second electric signal to the heating element prior to applying the third electric signal.

10. A method of heating a fluid, the method comprising:

applying a first electric signal to a heating element;

detecting a first value of an electrical characteristic during the application of the first electric signal;

applying a second electric signal to the heating element, the second electric signal being substantially different than the first electric signal;

reapplying the first electric signal to the heating element;

detecting a second value of the electrical characteristic during the reapplication of the first electric signal;

comparing the first value of the electrical characteristic to the second value of the electrical characteristic;

determining a potential dry-fire condition exists when the second value of the electrical characteristic varies by more than an amount from the first value of the electrical characteristic; and applying a high voltage alternating current signal to the heating element if the potential of a dry-fire condition does not exist.

11. The method of claim 10 wherein the first electric signal is a low-voltage, direct current signal.

12. The method of claim 10 wherein the second electric signal is a high-voltage, alternating current signal.

13. The method of claim 10 wherein the electrical characteristic is resistance.

14. The method of claim 10 wherein the electrical characteristic is voltage.

15. The method of claim 10 wherein the electrical characteristic is current.

16. The method of claim 10 wherein the method further comprises ceasing application of the first electric signal to the heating element prior to applying the second electric signal, and ceasing application of the second electric signal to the heating element prior to reapplying the third electric signal.

* * * * *